United States Patent [19]

Åkerblom

[11] 4,120,702

[45] Oct. 17, 1978

[54] TREATING A SILICON STEEL MATERIAL HAVING A SILICATE PROTECTIVE COATING THEREON WITH AN AQUEOUS SOLUTION CONTAINING PHOSPHATES TO FORM A FURTHER PROTECTIVE COATING

[75] Inventor: Carl Artur Åkerblom, Surahammar, Sweden

[73] Assignee: Asea Aktiebolag, Sweden

[21] Appl. No.: 813,255

[22] Filed: Jul. 6, 1977

[30] Foreign Application Priority Data

Oct. 29, 1976 [SE] Sweden ..... 7612028

[51] Int. Cl.[2] ..... C23F 7/10

[52] U.S. Cl. ..... 148/6.15 R; 148/6.17; 148/113; 427/104; 427/344

[58] Field of Search ..... 148/6.15 R, 113, 6.152; 427/344

[56] References Cited

U.S. PATENT DOCUMENTS

| | | | |
|---|---|---|---|
| 2,790,739 | 4/1957 | Frederick et al. | 148/6.15 R |
| 3,214,302 | 10/1965 | Brodt et al. | 148/6.2 |
| 3,930,897 | 1/1976 | Akerblom | 148/6.15 R |
| 3,996,073 | 12/1976 | Evans | 148/6.15 R |

*Primary Examiner*—Ralph S. Kendall

*Attorney, Agent, or Firm*—Watson, Cole, Grindle & Watson

[57] ABSTRACT

Silicon steel sheets which have a silicate protective coating are further protected by being first coated with an aqueous solution containing (1) phosphate ions, (2) silica grains, (3) iron and/or manganese ions, and (4) negative ions which convert to volatile products at temperatures below 400° C, and then heated to temperatures of between about 400° and 1100° C for periods of between about ½ minute to 10 minutes in order to form a further protective phosphate layer.

16 Claims, 2 Drawing Figures

TREATING A SILICON STEEL MATERIAL HAVING A SILICATE PROTECTIVE COATING THEREON WITH AN AQUEOUS SOLUTION CONTAINING PHOSPHATES TO FORM A FURTHER PROTECTIVE COATING

BACKGROUND OF THE INVENTION

1. Field of the Invention

The present invention relates to the treatment of silicon steel sheets, and more particularly to the treatment of silicate coatings on such sheets, in order to provide silicon steel sheets having electrically insulating protective coatings.

2. Description of the Prior Art

In the manufacture of silicon steel sheet material for use as so-called electrical sheets which have a grain orientation, after rolling and decarburization, the sheet material is conventionally heat treated at about 850° to 1350° C in order to achieve the necessary grain growth of the crystals, i.e., so that the sheet material will acquire the required magnetic properties. Before the heat treatment, however, the sheet material is usually coated with chemicals in order to produce, during the subsequent heat treatment, an electrically insulating protective coating.

One conventionally utilized coating has been a silicate or so-called "glass film" coating which consists of the reaction product of silicon dioxide and an alkaline earth metal oxide or hydroxide, the most common alkaline earth metal oxide or hydroxide being magnesium oxide or magnesium hydroxide. The coating is conventionally formed by applying to the surface of the sheet material a uniform layer of an aqueous suspension of the alkaline earth metal oxide or hydroxide and thereafter subjecting the sheet material to the noted heat treatment step, i.e., by subjecting the sheet material to a temperature of about 850° to 1350° C for several hours in a hydrogen atmosphere (the most optimum temperature being about 1000° to 1350° C in order to ensure that a well-developed glass film is formed). By these steps, the hydroxide, which is either in the suspension initially or which is formed from the oxide by reaction with water, liberates water as the temperature increases, and this water will, at temperatures below those mentioned, oxidize the silicon in the silicon steel sheet material to form silicon dioxide at the surface thereof. On the other hand, the iron itself will not be oxidized. The alkaline earth metal oxide, which is either still available from that in the original suspension or which is formed from the hydroxide after the liberation of water, then reacts with the silicon dioxide on the surface of the sheet material during the heat treatment to form the glass film. In another known process, the alkaline earth metal oxide or hydroxide can be replaced with an alkaline earth metal carbonate. In this alternative process the carbonate decomposes during heating to liberate carbon dioxide which then oxidizes the silicon on the sheet material to form silicon dioxide (without the oxidation of any iron), which then reacts the available alkaline earth metal oxide to form the glass film during the heat treatment.

In either of the noted processes, any excess unreacted oxide ultimately acts as a spacing material between adjacent layers of the sheet which are formed by turning the sheets into rolls or by use of the sheets as laminae in a stack. The excess oxide also helps prevent the layers from sticking or sintering together.

However, the conventional silicate coating as described above often has been found to have an insufficient electrical insulating resistance for many purposes to which the silicon steel sheets may be applicable, and as a result the protective coating has been often reinforced, either by treatment with phosphoric acid and metal phosphates, especially alkaline earth metal phosphates and aluminum phosphate (the older method), or by treatment with such solutions which also contain colloidal silica and chromic acid (this being the newer method) in order to form a further protective layer.

With regard to the latter-mentioned method, the incorporation of colloidal silica into the further protective coating results in improved insulation resistance, reduced dusting when the sheet material is machined, and favorable magnetostriction. On the other hand, the chromic acid is used to neutralize any excess phosphoric acids which are present either in the form of phosphoric acid in its original form from the original solution or else acids in a transformed state as a result of the heat treatment of the sheet material after the phosphate has been applied. The chromic acid functions due to the fact that at somewhat above 200° C it thermally decomposes and forms chronium (III) ions which then react with the phosphoric acids to form chromium (III) phosphate. By neutralizing the phosphoric acids in this way, flaking off of the silicate layer, which is normally caused by the phosphoric acids during heat treatment, is prevented. In addition, the retention of phosphoric acids on the sheet material, which would normally occur to a significant extent due to the hindered evaporation thereof (as a result of the presence of the colloid silica) is prevented. In this regard, such undesirably retained phosphoric acids will normally diffuse out to the surface of the phosphate layer after the finished sheet has been stored for some time where it will take up water and become quite active in destroying the insulation coating.

However, it has now been discovered that even when the silicate layer is treated as noted above, the chromium (III) phosphate in fact can dissolve out from the phosphate layer if the sheet comes into contact with water (this occurs, for example, when the sheet material is handled or when it is used in a transformer where the oil is seldom entirely free of water), and this loss of chromium (III) phosphate can lead to a break in the layer such that its insulating ability is completely destroyed.

It is thus an object of the present invention to provide a method of neutralizing the excess phosphoric acids which are present on the protective layers overlying the silicate coatings on silicon steel sheets or objects in such a way that the formed phosphate compounds are either completely insensitive or else almost completely insensitive to water leaching.

SUMMARY OF THE INVENTION

According to the present invention the excess phosphoric acids are neutralized by using certain iron and/or manganese compounds in the reinforcing solution so as to produce phosphate reaction products which will be insensitive or almost insensitive to water, such that the insulation value of the silicon steel sheet material will remain intact when the sheet is handled and used. In addition, due to the make up of the inventive reinforcing solution the use of chromium compounds will be entirely avoided, resulting in the additional advantage in that no environmental pollution will any way be produced.

In particular the present invention relates to a method of treating an object of silicon steel, for example, a silicon steel object in the form of a sheet or strip which can be used in motors, generators or transformers and which has a silicate protective coating, wherein the object with the silicate protective coating is contacted with an aqueous solution which contains phosphate ions and which also contains colloidal or suspended silica, iron and/or manganese ions, and negative ions which are capable of being converted into volatile products at temperatures below 400° C so as to form a further protective layer upon heat treatment. Such an aqueous treatment solution will be hereinafter referred to as a phosphate solution.

DETAILED DESCRIPTION OF THE INVENTION

The silicon steel objects which can be treated by the phosphate solution of the present invention are objects which have a conventional silicate coating thereon. Thus, the silicon steel objects have a silicate coating thereon which may be formed by applying thereto an aqueous suspension of an oxide, a hydroxide or a carbonate of an alkaline earth metal and then heating the objects to at least 850° C, preferably to 1000° - 1350° C, in either a vacuum atmosphere, a nitrogen gas atmosphere, a hydrogen gas atmosphere, or any other inert or reducing atmosphere. The oxide, hydroxide or carbonate is usually in the form of magnesium oxide, hydroxide or carbonate, but other alkaline earth metals can replace the magnesium, i.e. calcium, barium or strontium. If an alkaline earth metal oxide is used in the initial aqueous coating solution, a substance which is capable of oxidizing the silicon in the silicon steel is simultaneously used also, usually in the form of water bound to the alkaline earth metal as the hydroxide. The thickness of the protective coating ultimately produced may range from monomolecularity up to about 10 microns, but particularly favorable results according to the present invention are produced when the coating ranges from 0.1 to 5 microns, most particularly from 0.1 to 1 micron.

In the process of the present invention the excess unreacted alkaline earth metal oxide is advantageously brushed away from the object prior to application of the inventive phosphate solution.

The inventive phosphate solution is applied to the silicate layer on the silicon steel object in the form of a layer and then the object is heated to at least 400° C, suitably 400° to 1100° C (and most preferably to 700° to 850° C) for at least ½ minute, preferably for a period from ½ minute to 10 minutes (although longer periods are not harmful). The heating step may be conducted in an oxidizing, reducing or inert atmosphere, i.e., the type of atmosphere is not at all critical; indeed, an atmosphere containing air can be advantageously used. A further protective layer on top of the silicate layer is thereby produced.

Concerning the phosphate solution itself, it consists of an aqueous solution containing (1) phosphate ions, preferably monophosphate ions, (2) colloidal or suspended silica, preferably silica having grain sizes below about 16 microns, (3) iron and/or manganese ions, and (4) "negative ions" which are ions that have the ability to be converted into volatile products at temperatures below 400° C, e.g. sulphate ions, acetate ions and nitrate ions (these being preferred for economic reasons) or sulphite ions, or ions of a plurality of organic acids such as formic acid, propione acid, and other like acids. The aqueous solution is acidic in nature and preferably has a pH of between about 0.8 and 3.7. With respect to the iron and/or manganese ions in the solution, it is preferred to use both iron and manganese ions, and in a ratio of 0.75 to 1.25 moles of manganese ions per mole of iron ions because a particularly good water resistance can then be achieved in the treated silicate layer on the silicon steel product.

In addition to the foregoing, the phosphate solution according to the present invention preferably also contains aluminum and/or magnesium ions because the presence of these ions make the treated insulated sheet less sensitive to the conditions which prevail during the stress-relieving annealing treatment to which the sheet product is often subjected. Also, insoluble fillers may also be added to the phosphate solution, e.g., fillers such as highly dispersed refractory boron-treated silica or mica powders which have grain sizes below about 10 microns. These fillers tend to increase the resistivity of the treated silicate protective coating.

With respect to the amounts of the components useful in the inventive phosphate solution, the following quantities per 100 parts by weight of silica are preferred (calculated as $SiO_2$ without water):

10–200, preferably 50–150, parts by weight of phosphate ions (calculated as $PO_4^{3-}$);
1–30, preferably 2–20, parts by weight of iron ions or manganese ions, or both together;
0–25, preferably 2–20, parts by weight of aluminum ions or magnesium ions, or both together;
an amount of "negative ions" such that the solution contains a sufficient amount of metal ions to react with the phosphate ions of the solution, preferably an amount exactly equivalent to the amount of hydrogen ions in the solution or else which deviates therefrom by a maximum of 40 (preferably 25) per cent; and when fillers are added;
5 to 50 parts by weight, preferably 10 to 30 parts by weight, of fillers.

The thickness of the applied layer of phosphate solution is 0.1 to 20 microns, preferably 0.5 to 5 microns, and most preferably 1 to 3 microns.

The present invention will now be explained by way of a number of examples and with reference to the accompanying drawing.

EMBODIMENTS

Figure 1:
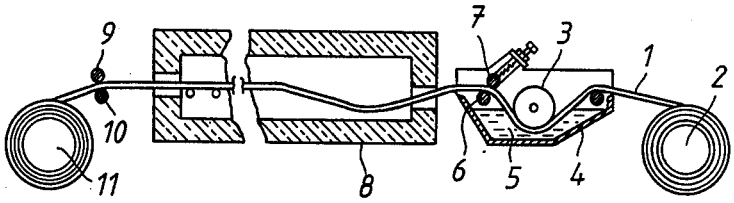
FIG. 1 shows in schematic fashion an apparatus for the application of a protective coating of silicate onto a silicon steel sheet.

In FIG. 1, a sheet of silicon steel 1 having a thickness of 0.3 mm is shown which has been pretreated to have a grain orientation and which has been decarburized at 720° - 900° C (preferably 820° C) in a wet hydrogen atmosphere. The sheet is drawn from a coil on a reel 2 and passes under a roll 3 which rotates in a pan 4 containing a suspension 5 of the particulate material with which the sheet is to be coated. The suspension 5 can, for example, be manufactured by suspending 90 parts by weight of magnesium oxide consisting of particles, 95 per cent by weight of which have a grain size of less than 5 microns and the rest of which have a grain size of less than 25 microns, in 1000 parts by weight water. After passing the pan 4, the sheet is passed between wiping rollers 6 and 7, which are suitably rubber-clad, and into a furnace 8 where it is dried at a temperature of about 100° C for about 30 seconds before it is coiled up on the reel 11 after having passed the transport rollers 9 and 10. Thereafter, the sheet is annealed (at high temperature) in a batch annealing furnace at around 1000° to 1350° C in a hydrogen atmosphere for several hours, during which time a protective coating of silicate with a thickness of 1 micron is formed on the sheet.

Figure 2:
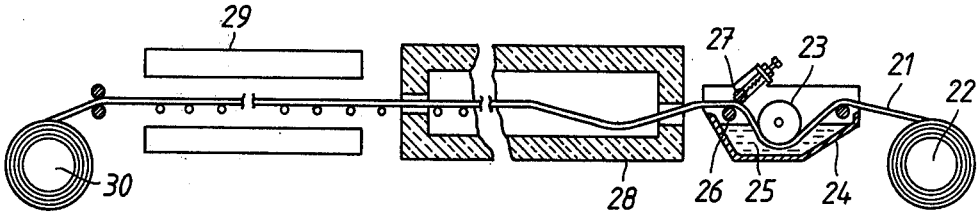
FIG. 2 shows in schematic fashion an apparatus for the application of a phosphate coating according to the present invention onto a sheet material provided with a protective coating of silicate.

When the sheet which has been treated in the way indicated in FIG. 1 has been liberated from excess coating by brushing, it is coated with phosphate in the means according to FIG. 2. More specifically, the sheet, which is there designated 21, is drawn from a reel 22 and passes under a roll 23 rotating in a pan 24 with a solution 25 of phosphate in water, possibly containing suspended filler (as noted in the following Examples). The sheet is then passed between the wiping rollers 26 and 27 which are suitably rubber-clad and into a furnace 28, after which the sheet is cooled in a cooling device 29, before it is coiled up on the reel 30. The concentration of phosphate in the treatment liquid 25 is adjusted with regard to the profile of the rubber rollers 26 and 27 and to the roller pressure so that the desired thickness of the phosphate layer is obtained. For all the compositions of the solution 25 exemplified in the Examples below, the furnace 28 had a temperature of 800° C and the time for the sheet to pass through the furnace was 2 minutes. The furnace atmosphere was air. The thickness of the phosphate layer in the exemplified cases was 2 microns. Examples of the preparation of the solution 25 are indicated by the following Examples.

EXAMPLE I

A solution was prepared from 20 parts by weight of ferrous sulphate ($FeSO_4.7H_2O$), 15 parts by weight of phosphoric acid ($d=1.54$), 100 parts by weight of water and 180 parts by weight of colloidal silica containing 300 grams of $SiO_2$ per liter and with a particulate size of the silica of 100–200 Angstroms and a specific surface of 250 $m^2$ per gram.

EXAMPLE II

A solution was prepared from 20 parts by weight of manganese sulphate ($MnSO_4.H_2O$), 15 parts by weight of phosphoric acid ($d=1.54$), 100 parts by weight of water and 180 parts by weight of colloidal silica of the kind stated in Example I.

EXAMPLE III

A solution was prepared from 6.7 parts by weight of ferrous sulphate ($FeSO_4.7H_2O$), 13.3 parts by weight of manganese sulphate ($MnSO_4.H_2O$), 24 parts by weight of phosphoric acid ($d=1.54$), 40 parts by weight of aluminium phosphate solution (600 g $AlPO_4$/1, pH 2), 25 parts by weight of water and 180 parts by weight of colloidal silica of the kind stated in Example I.

EXAMPLE IV

A solution was prepared from 70 parts by weight of magnesium phosphate solution (400 g $Mg(H_2PO_4)_2$/1, pH 1.8), 67 parts by weight of aluminium phosphate solution (600 g $AlPO_4$/1, pH 2.0), 8 parts by weight of manganese sulphate ($MnSO_4.H_2O$) and 180 parts by weight of colloidal silica of the kind stated in Example I.

EXAMPLE V

A solution was prepared from 42 parts by weight of aluminium phosphate solution (600 g $AlPO_4$/1, pH 2.0), 11 parts by weight of ferrous sulphate ($FeSO_4.7H_2O$), 9 parts by weight of manganese sulphate ($MnSO_4.H_2O$), 24 parts by weight of phosphoric acid ($d=1.54$), 180 parts by weight of colloidal silica of the kind stated in Example I, and also 70 parts by weight of water.

RESULTS

The electrically insulated silicon steel sheets produced as a result of the treatment sequences noted in conjunction with FIGS. 1 and 2 utilizing phosphate solutions according to Examples 1–5 were all insensitive to water and the insulation layers displayed excellent adhesion to the base silicon steel sheets. In addition, the magnetostrictive properties were all very good.

While there has been shown and described what is considered to be the preferred embodiments of the present invention, it will be obvious to those skilled in the art that various changes and modifications may be made therein without departing from the invention as defined in the appended claims.

I claim:

1. A process for reinforcing a silicon steel material which has an alkaline earth metal silicate protective layer thereon comprising the steps of coating the alkaline earth metal silicate protective layer with an aqueous solution containing colloidal or suspended silica; 10–200 parts by weight phosphate ions, based on 100 parts by weight of silica calculated as $SiO_2$ without water; 2–20 parts by weight of ions selected from the group consisting of iron and manganese ions, or both; and an amount of negative ions which deviates from an equivalent amount of hydrogen ions in the solution by a maximum of 40 percent and which are capable of converting to volatile products at temperatures of below 400° C; and then heating the coated silicon steel material to form a further protective phosphate layer over the alkaline earth metal silicate protective layer.

2. The process according to claim 1 wherein said aqueous solution further contains aluminum ions.

3. The process according to claim 1 wherein said aqueous solution further contains magnesium ions.

4. The process according to claim 1 wherein said heating of said coated silicon steel material is conducted for a period of about ½ minute to 10 minutes and at a temperature of between about 400° and 1100° C.

5. The process according to claim 4 wherein said temperature is between about 700° and 850° C.

6. The process according to claim 1 wherein said negative ions are selected from the group consisting of sulphate ions, acetate ions and nitrate ions.

7. The process according to claim 1 wherein said aqueous solution has a pH ranging from about 0.8 to 3.7.

8. The process according to claim 1 wherein said phosphate ions consist of monophosphate ions.

9. The process according to claim 1 wherein said aqueous solution further includes insoluble filler powders.

10. The process according to claim 9 wherein said insoluble filler powders are selected from the group consisting of refractory boron-treated silica powder and mica powder.

11. The process according to claim 1 wherein the amount of negative ions is equal to the amount of hydrogen ions in the solution.

12. The process according to claim 1 wherein said solution contains 20 parts by weight of ferrous sulphate ($FeSO_4.7H_2O$), 15 parts by weight of phosphoric acid ($d=1.54$), 100 parts by weight of water and 180 parts by weight of colloidal silica containing 300 grams of $SiO_2$ per liter.

13. The process according to claim 1 wherein said solution contains 20 parts by weight of manganese sulphate ($MnSO_4.H_2O$), 15 parts by weight of phosphoric acid ($d=1.54$), 100 parts by weight of water and 180 parts by weight of colloidal silica containing 300 grams of $SiO_2$ per liter.

14. The process according to claim 1 wherein said solution contains 6.7 parts by weight of ferrous sulphate ($FeSO_4.7H_2O$), 13.3 parts by weight of manganese sulphate ($MnSO_4.H_2O$), 25 parts by weight of phosphoric acid ($d=1.54$), 40 parts by weight of water and 180 parts by weight of colloidal silica containing 300 grams of $SiO_2$ per liter.

15. The process according to claim 1 wherein said solution contains 70 parts by weight of magnesium phosphate solution (400 g $Mg(H_2PO_4)_2$/1, pH 1.8), 67 parts by weight of aluminium phosphate solution (600 g $AlPO_4$/1, pH 2.0), 8 parts by weight of manganese sulphate ($MnSO_4.H_2O$) and 180 parts by weight of colloidal silica containing 300 grams of $SiO_2$ per liter.

16. The process according to claim 1 wherein said solution contains 42 parts by weight of aluminium phosphate solution (600 g $AlPO_4$/1, pH 2.0), 11 parts by weight of ferrous sulphate ($FeSO_4.7H_2O$), 9 parts by weight of manganese sulphate ($MnSO_4.H_2O$), 24 parts by weight of phosphoric acid ($d=1.54$), 180 parts by weight of colloidal silica containing 300 grams of $SiO_2$ per liter.

* * * * *